US005860798A

United States Patent [19]

Tschopp

[11] Patent Number: 5,860,798

[45] Date of Patent: Jan. 19, 1999

[54] PUMP FOR PUMPING A FLUID COMPRISING A LIQUEFIED GAS AND APPARATUS HAVING A PUMP

[75] Inventor: Claudio Tschopp, Muttenz, Switzerland

[73] Assignee: Cryopump AG, Aesch, Switzerland

[21] Appl. No.: 609,668

[22] Filed: Mar. 1, 1996

[30] Foreign Application Priority Data

Mar. 3, 1995 [CH] Switzerland ..... 616/95

[51] Int. Cl.[6] ..... F04B 23/00; F04B 15/08

[52] U.S. Cl. ..... 417/502; 417/553; 417/570; 417/439; 417/901; 62/50.6

[58] Field of Search ..... 417/901, 245, 417/553, 570, 360, 454, 502, 439; 62/50.6

[56] References Cited

U.S. PATENT DOCUMENTS

| | | | |
|---|---|---|---|
| 3,446,156 | 5/1969 | Lightfoot et al. . | |
| 4,239,460 | 12/1980 | Golz | 417/901 |
| 4,396,362 | 8/1983 | Thompson et al. | 417/439 |
| 4,576,557 | 3/1986 | Pevzner . | |
| 4,915,602 | 4/1990 | Tschopp | 417/503 |

FOREIGN PATENT DOCUMENTS

| | | | |
|---|---|---|---|
| 1169973 | 5/1964 | Germany . | |
| 958328 | 5/1964 | United Kingdom | 417/901 |

*Primary Examiner*—Charles G. Freay
*Attorney, Agent, or Firm*—Anderson, Kill & Olick, P.C.

[57] ABSTRACT

The pump has a sleeve-like bearer. This contains a bush in which a piston is displaceable along an axis. The bearer inner surface and the bush outer surface are adjacent to one another in parts and are separated from one another in parts by an intermediate space. The inlet of the pump is connected through an intake chamber located at least partly inside the bush and through the piston, via a non-return valve, to a pump chamber, which is connected via another non-return valve to a primary outlet of the pump. The intermediate space connects the inlet and the intake chamber to a secondary outlet which is a distance away, along the axis, from the inlet and the intake chamber. During the operation of the pump, fluid flows from the inlet through the intermediate space to the secondary outlet and cools the bush.

26 Claims, 2 Drawing Sheets

PUMP FOR PUMPING A FLUID COMPRISING A LIQUEFIED GAS AND APPARATUS HAVING A PUMP

BACKGROUND OF THE INVENTION

1. Field of the Invention

The invention relates to a pump for pumping a fluid comprising a liquefied gas.

Such a pump, defined as a cryogenic pump, can be used, for example, for pumping a cryogenic fluid which at least partly comprises at least one liquefied gas—such as liquefied nitrogen, oxygen, hydrogen or argon or liquefied air—and may also comprise gaseous fluid. The pump may also be used for pumping liquefied butane or propane. The pump can be formed, for example, for pumping fluid from a reservoir into a container or any apparatus and for increasing the pressure of the fluid from a value of, for example, at most 1.5 MPa to, for example, 15 to 50 MPa.

2. Description of the Prior Art

A pump disclosed in U.S. Pat. No. 4,915,602 has a drive device with a support and a pump housing. This has an elongated, sleeve-like bearer, which is fixed to the support, and a bush which is partly inserted into said bearer and is closed at its end projecting from the bearer by an end member. A piston which is displaceable in the bush is connected to a movable part of the drive device by a piston rod. The inner surface of the sleeve-like bearer has annular grooves into which seals for sealing the piston rod fit. The largest part of the bearer, the bush and the end member are present in a container whose wall has a shell connected tightly and firmly in the vicinity of the drive device to the bearer and a shell which can be detached by means of screws and is connected by means of said bolts. The two shells have an inner wall, an outer wall and an evacuated intermediate space in between. The inlet of the pump is connected to a pump chamber which is present in the bush and adjacent to the end face of the piston by the inner space of the container and two flow paths each having a non-return valve. The pump chamber is furthermore connected to a primary outlet via a non-return valve. The container has a secondary outlet through which vaporized fluid flows out of the container during operation.

This pump has proved satisfactory per se. However, the production costs of the pump are increased by the production and assembly of the wall of the container containing the major part of the sleeve-like bearer and bush, which wall consists of a plurality of parts and has evacuated intermediate spaces. In addition, the maintenance of the known pump gives rise to a relatively large amount of work and long down times. If, for example, the bush and the piston are to be cleaned or one of the seals attached to the piston or in the sleeve-like bearer or a part of a non-return valve are to be replaced, it is necessary, inter alia, to separate the two shells of the container from one another and then connect them together again and to slacken a number of bolts and nuts and screw them together again afterwards.

The pump disclosed in German Examined Patent Application 1,169,973 and intended for pumping a liquefied gas possesses an elongated, hollow bearer, a bush present partly in the inner space of the bearer and displaceable piston. The bush has two collars adjacent to the inner surface of the bearer and, between said collars, is separated from the inner surface of the bearer by an intermediate space. A reservoir is connected via a feed pipe to the inlet opening into the intermediate space. The bush contains a pump chamber which is adjacent to the end face of the piston and is connected to a primary outlet of the pump via a non-return valve. The bearer is provided with a secondary outlet which is connected to the intermediate space and is connected via a return pipe to the reservoir. The piston is hollow and has, in its end face, an orifice which can be closed by means of an axially displaceable closure member and forms a valve together with the latter. The stated intermediate space is connected by radial holes in the wall of the bush and by elongated holes in the wall of the hollow piston to the cavity present therein. During operation of this pump, fluid flows from the reservoir through the feed pipe and the inlet into the stated intermediate space and from this into the cavity of the piston. If the piston is moved back and forth, fluid can pass from the cavity of the piston into the pump chamber and can be transported by the piston from there to the primary outlet. If the fluid present in the intermediate space is heated, it expands, fluid also vaporizing. Fluid can then flow from the intermediate space through the secondary outlet and the return pipe back into the reservoir.

In this known pump, that section of the bearer which contains the bush has an external diameter which is large in comparison with the diameters of the bush and of the piston, and a large outer surface adjacent to the environment of the pump. Furthermore, that section of the bush which contains the pump chamber projects from the bearer. Thus, a large amount of heat can flow from the environment of the pump through the bearer and the bush end section projecting from said bearer into the bearer and the bush. The cryogenic fluid is thus greatly heated so that a large amount of fluid vaporizes. Furthermore, the secondary outlet is in the same longitudinal section of the bearer as the inlet and is connected to this at the highest point of the intermediate space. Furthermore, the cross-sectional area of the intermediate space is very much larger than the cross-sectional area of the inlet passage. There is therefore no defined fluid flow in the intermediate space. The intermediate space can in certain circumstance therefore contain relatively warm liquid or gas bubbles at different points, and this warm liquid and these gas bubbles may remain for a long time in the intermediate space. In addition, the liquid flowing through the holes of the bush into the bush and the cavity of the piston is pushed back and forth during displacement of the piston, but the volume of the cavity remains constant and is permanently relatively large. Gas bubbles may therefore also enter the cavity of the piston and remain therein for a relatively long time. However, gas bubbles present in the intermediate space and in the cavity of the piston reduce the efficiency of the pump and may even cause breakaway of the liquid flow. This known pump therefore does not function reliably and in particular is scarcely suitable for continuous operation over long periods. The operational reliability of the pump according to German Examined Patent Application 1,169,973 could be improved at most by thermally insulating from the environment the bearer and the bush section projecting from it by means of an additional insulation. However, such an additional insulation is not disclosed and would furthermore probably have disadvantages similar to those of the shells of the pump disclosed in U.S. Pat. No. 4,915,602.

The reservoir frequently also contains solid, fine impurity particles which are dispersed in liquefied gas and, for example, consist of a carbon compound and, together with the liquefied gas, may enter the bearer, the bush and the cavity of the piston. Since no defined, strong flow occurs in the intermediate space of the bearer and also in relatively large parts of the cavity of the piston of the pump according to German Examined Patent Application 1,169,973, impurity particles may accumulate in the interior of the bearer and in the piston, so that the pump frequently has to be dismantled and cleaned.

The piston rod which serves for moving the piston must be sealed somewhere. German Examined Patent Application 1,169,973 does not disclose any seals which serve this purpose. However, it appears probable that the changing of these seals which is required in practice usually after a certain number of operating hours necessitates a relatively long down time, similarly to the pump described above and disclosed in U.S. Pat. No. 4,915,602.

SUMMARY OF THE INVENTION

It is the object of the invention to eliminate disadvantages of the known pumps. Starting from the pump according to German Examined Patent Application 1,169,973, it is intended in particular to permit reliable operation of the pump with good efficiency over a longer time. The pump should be capable of being produced economically and should permit simple maintenance requiring only short down times.

This object is achieved according to the invention by a pump for pumping a fluid comprising a liquefied gas, comprising a bearer, a bush arranged at least partly therein, a piston displaceable along an axis in said bush, an inlet, a primary outlet and a secondary outlet, the bearer having a bearer inner surface and the bush having a bush outer surface which is supported in parts by the bearer inner surface and is separated in parts from this by an intermediate space, the piston bounding a pump chamber, the inlet and the secondary outlet being connected to the intermediate space and the inlet being connected via a non-return valve to the pump chamber and the latter being connected by a non-return valve to the primary outlet, and wherein the secondary outlet is connected to the intermediate space at a point which is a distance away, along the axis, from a point at which the intermediate space is connected to the inlet.

Another object is achieved by an apparatus comprising a pump, wherein a reservoir having an interior for storing an at least partially liquid, cryogenic fluid is present, wherein the reservoir is connected to the inlet by a feed pipe, wherein the secondary outlet is connected to the reservoir by a return pipe and wherein the return pipe opens into the interior of the reservoir at an entrance which is above the point at which the feed pipe is connected to the interior of the reservoir.

BRIEF DESCRIPTION OF THE DRAWINGS

The subject of the invention is illustrated in more detail below with reference to an embodiment shown in the drawings. In the drawings.

DESCRIPTION OF THE PREFERRED EMBODIMENT

Figure 1:
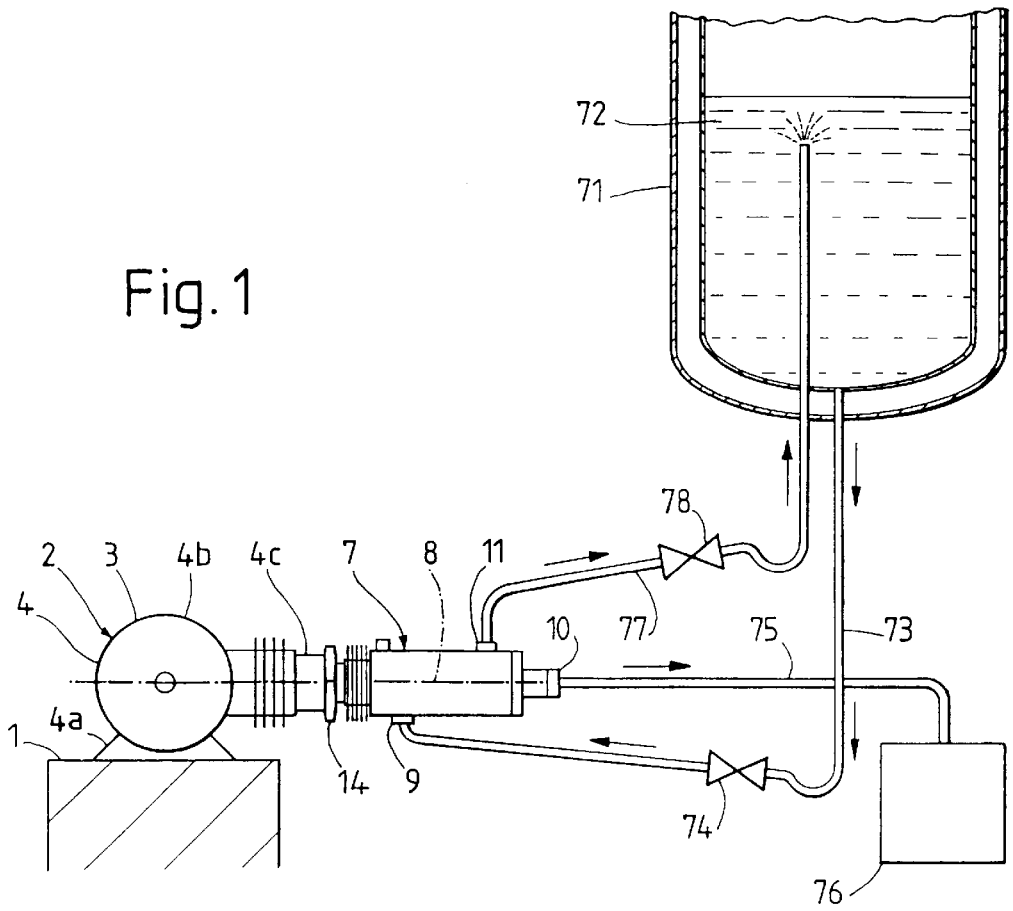
FIG. 1 shows a view of a pump and a section through a reservoir connected to said pump.
Figure 2:
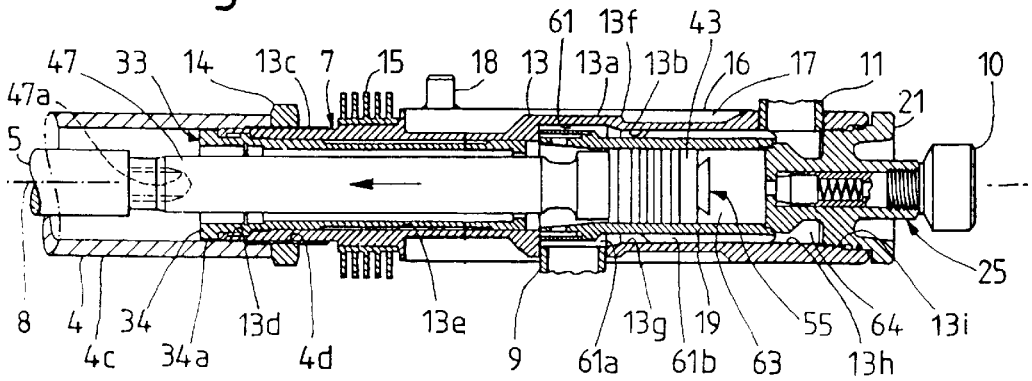
FIG. 2 shows a section through the pump housing containing the piston of the pump, on a larger scale than FIG. 1.

FIG. 1 shows a rest 1 and a pump 2 shown in simplified form and having a drive device 3. The latter possesses a support 4 which is at rest when the pump is in operation. The support 4 has a base 4*a* which stands on the rest 1 and, for example, is fastened to said rest, a motor housing 4*b* and a hollow, sleeve-like connecting section 4*c* which projects away horizontally from said housing. That end section of said connecting section which faces away from the motor housing 4*b* and is also visible in FIG. 2 is provided with an internal thread 4*d*. The drive device 3 has an electric motor with a rotor which is arranged in the motor housing 4*b* and is not shown and whose shaft is connected to a crank or cam. This in turn is connected via a connecting rod or the like to a part 5 of the drive device 3, which part is movable, namely can be displaced back and forth, and is indicated in FIG. 2.

Figure 3:
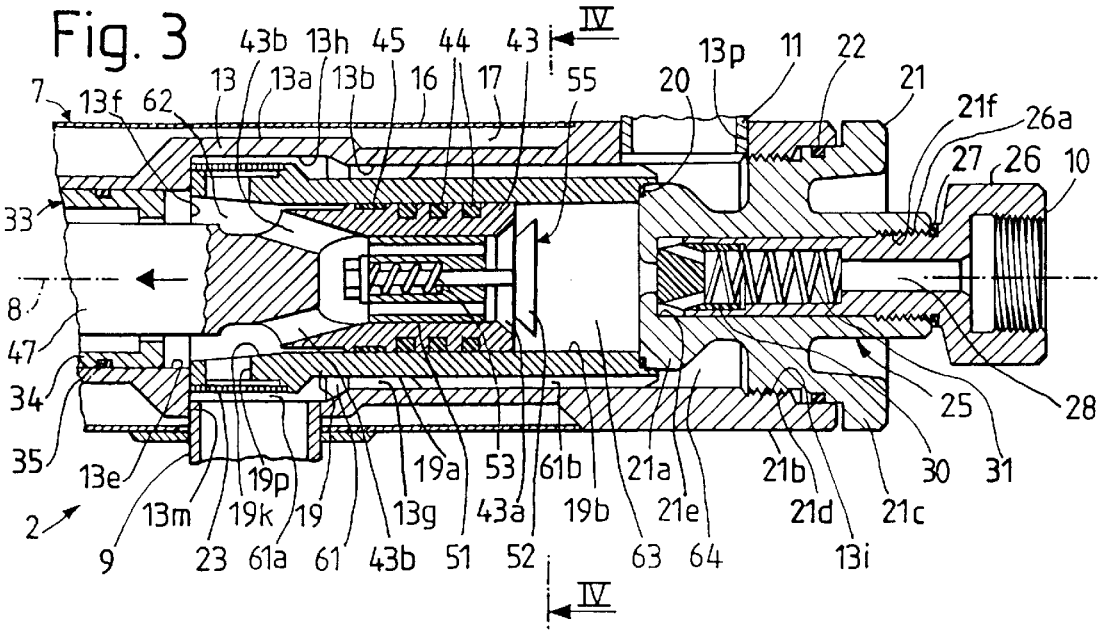
FIG. 3 shows a part of FIG. 2 on an even larger scale.
Figure 4:
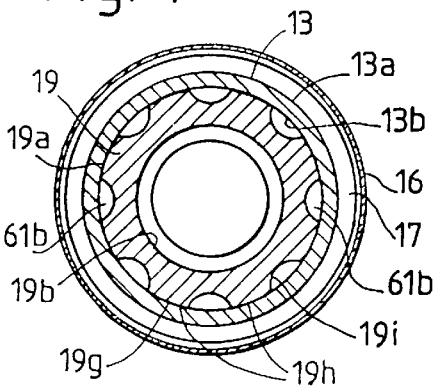
FIG. 4 shows a cross-section through the housing of the pump along the line IV—IV of FIG. 3, some parts having been omitted.
Figure 5:
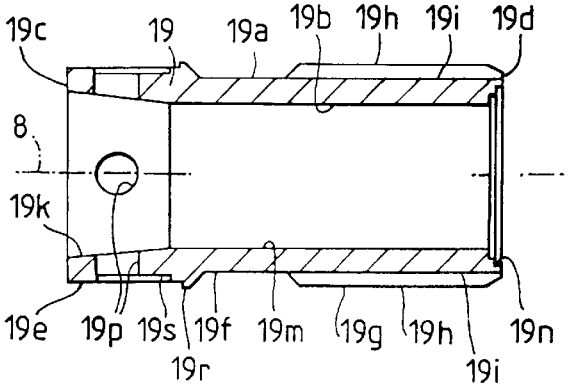
FIG. 5 shows a longitudinal section through the separately drawn bush which serves for guiding the piston.

A pump housing 7 which is shown as a view in FIG. 1 and as a section in FIGS. 2 and 3 defines, together with the connecting section 4*c* of the support 4, a horizontal axis 8 and has three fluid connections, namely an inlet 9, a primary or pressure outlet 10 and a secondary or return outlet 11, and an elongated bearer 13 which is in general rotationally symmetrical with respect to the axis 8 and is also shown in FIG. 4. The bearer 13 is formed by a one-piece, approximately cylindrical sleeve open at both ends and consists of metallic material, namely of stainless steel. The bearer 13 has a wall or a jacket with a bearer outer surface 13*a* and a bearer inner surface 13*b* which surrounds the axis 8 and, in cross-section, a bearer inner space. That end section of the bearer outer surface 13*a* which is to the left in FIG. 2 is provided with an external thread 13*c*. At that end of the bearer 13 which is on the left in FIG. 2, the bearer inner surface 13*b* has a short section which is provided with an internal thread 13*d* and is adjacent to a relatively long, narrower cylindrical section 13*e*. This is connected via a radial shoulder surface 13*f* to a further, cylindrical section 13*g*. This is provided with an annular groove 13*h* which bounds the shoulder surface 13*f* and forms a section of this. An internal thread 13*i* is present in the vicinity of the right end of the bearer 13. The wall of the bearer 13 has a hole 13*m* which is radial with respect to the axis 6 and opens into the annular groove 13*h* at the lowest circumferential point of said groove. The inlet 9 is formed by the hole 13*m* and a connecting element which projects into said hole, is connected tightly, namely welded, to the bearer 13 and, for example, consists of a connecting piece or pipe section or the like. The bearer 13 furthermore has a hole 13*p* which is radial with respect to the axis 6 and opens into the cylindrical section 13*a* at the highest circumferential point of the further cylindrical section 13*g* in the vicinity of its end facing away from the annular groove 13*h*. The secondary or return outlet 11 is formed by the hole 13*p* and a connecting element which projects into said hole and is connected tightly, for example welded, to the bearer 13 and, for example, consists of a connecting piece or pipe section or the like. The entrance of the secondary or return outlet 11 into the hearer inner space is thus located above the entrance at which the inlet 9 opens into the bearer inner space.

The bearer 13 is detachably connected to the support 4 and namely screwed with its external thread 13*c* into the internal thread 4*d* of the support 4. The screw connection is secured by means of a lock nut 14 screwed onto the external thread 13*c*.

A metallic sleeve 15 which, for example, consists of aluminum and has a number of annular or disc-like ribs which serve for improving the heat exchange with the environment is fixed to, namely pressed onto, that cylindrical section of the bearer outer surface 13*a* which is adjacent to the external thread 13*c*. A cylindrical jacket 16 is tightly connected—for example welded—in the vicinity of the sleeve 15 and in the vicinity of the secondary or return outlet 11 to annular sections of the bearer outer surface 13*a* and, together with that section of the bearer outer surface 13*a* which is located between these last-mentioned sections, bounds a cavity 17 which is annular in cross-section. The cavity 17 is penetrated by the connecting member of the inlet 9 and is tightly sealed from the environment of the pump 2. The jacket 16 is provided with a connecting piece which forms a connection 18. This possesses a closable passage through which the cavity 17 can be evacuated by the pump manufacturer and/or possibly later by the user of the pump before the use of the latter.

A bush 19 which is shown in FIGS. 2 to 5 and is open at both ends is coaxial and essentially rotationally symmetrical with respect to the axis 8 and is essentially a hollow cylinder. The bush 19 has a wall or a jacket with a bush outer surface 19*a*, a bush inner surface 19*b* and two annular, radial, flat end surfaces 19*c*, 19*d* which are located at the left and right ends, respectively, of the bush in FIGS. 2, 3 and 5. The bush outer surface 19*a* has a short, generally cylindrical section 19*e* at its end located on the left in FIGS. 2, 3 and 5. Said section 19*e* is separated, by a collar 19*r* which projects away from said section towards the outside, from a thinner section 19*f* which is smooth and completely cylindrical. This is followed by a generally cylindrical section 19*g* which has axial ribs 19*h* uniformly distributed over the circumference and has grooves 19*i* present between said ribs 19*h*, at least three and, for example, eight ribs 19*h* and the same number of grooves 19*i* being present. The ribs 19*h* have, at their outer ends, surfaces which are arc-shaped in cross-section and together define a cylindrical surface whose diameter is greater than the diameter of the smooth, cylindrical section 19*i*. The grooves 19*i* are arc-shaped in cross-section and, for example, have dimensions such that their deepest point connects continuously with the cylindrical section 19*f*. The section 19*g* having the ribs 19*h* and grooves 19*i* is connected to the radial, annular end surface 19*d* of the bush by a conical transition surface inclined inward away from said section 19*g*. The end surfaces of ribs 19*h* are formed by sections of these conical transition surface. The length of the ribs 19*h* and of the grooves 19*i* is preferably at least 30% and, for example, 50% to 70% of the total length of the bush. The bush inner surface 19*b* has, at its end located on the left in FIGS. 2, 3 and 5, a conical section 19*k* tapering away from said end. Adjacent to section 19*k* is a smooth cylindrical section 19*m* whose length is at least 50% and, for example, at least or about 70% of the total length of the bush 19. The bush inner surface 19*b* has, at that end of the bush which is located on the right in FIGS. 2 and 3, a short, stepped extension 19*n* having two cylindrical sections. The generally cylindrical section 19*e* of the bush outer surface is provided with an annular groove 19*s*. In the vicinity of its end located on the left in FIGS. 2, 3 and 5, the bush 19 has at least one radial hole 19*p* and namely a plurality of holes 19*p* distributed uniformly around its circumference. Said holes lead from the base of the annular groove 19*s* through the jacket of the bush and open into the conical section 19*k* of the bush inner surface 19*b*. The bush 19 consists of a one-piece body of metallic material, namely of hardened, stainless steel.

The bush 19 is located completely in the interior of the sleeve-like bearer 13 and for the most part in that region of the bearer inner space which in cross-section is surrounded by the further, cylindrical section 13*g* of the bearer inner surface 13*b*. The bush has its radial, flat end surface 19*c* adjacent to the radial, flat shoulder surface 13*f* of the bearer 13. The bush 19 rests with those sections of the bush outer surface 19*a* which are formed by the vertices of the ribs 19*h* against the further, cylindrical section 13*g* of the bearer inner surface 13*b* at least almost without play and, for example, also at least almost fluid-tight, the adjacent surfaces of the bearer and of the bush together forming, for example, a sliding fit. That end of the bush 19 which is located on the right in FIGS. 2 and 3 projects slightly into that longitudinal region of the bearer inner space into which the hole 13*p* opens.

A seal 20 consisting of a copper ring is inserted into the extension 19*n* of the bush inner surface. The pump housing 7 possesses an end member 21 at its end which faces away from the drive device 3 and is located on the right in FIGS. 1 to 3. This end member possesses a thinner end section 21*a*, a middle thicker section 21*b* and an even thicker end section 21*c*. The thinner end section 21*a* and at least the major part of the middle end section 21*b* are located in the interior of the bearer 13, whereas the thicker end section 21*c* is located outside of this. The middle section 21*b* is provided with an external thread 21*d*. This is screwed onto the internal thread 13*i* of the bearer 13. The end member 21 possesses an axial, stepped through-hole 21*e*. This is provided with an internal thread 21*f* at its end facing away from the drive device 3. The thinner end section 21*a* of the end member projects with at most slight radial play into the extension 19*n* of the inner surface of the bush 19. The end section 21*a* presses on its end face with a radial, flat shoulder surface against the seal 20 and presses the bush 19 against the shoulder surface 13*f* via the seal 20. The bush 19 is thus centred coaxially with respect to the axis 8 by the adjacent sections of the bearer inner surface 13 and the bush outer surface 19*a* and is secured against axial displacements, firmly clamped and detachably connected to the bearer by the end member 21. That end section 21*c* of the end member 21 which is located outside the bearer 13 has about the same diameter as that end of the sleeve-like bearer 13 located on the right in FIGS. 1 to 3 and has a radial annular surface which faces the radial end surface of said bearer and is separated from said radial end surface by a narrow gap or may be adjacent to said radial end surface. The connection of the end member 21 to the bearer 13 is sealed by means of a seal 22 arranged in the vicinity of the outer ends of the thread 13*i*, 21*d*. The end member 21 tightly seals both the inner space of the bearer 13 and the inner space of the bush 19 at that end of the relevant inner space which faces away from the drive device 3.

An annular filter 23 is pushed onto the cylindrical section 19*e* of the bush outer surface 19*a* and is secured against axial displacements and firmly held by the radial shoulder surface 13*f* of the bearer 13 and a radial surface of the collar 19*r*.

The end member 21 is provided with a non-return valve 25. A nipple 26 possesses an external thread 26*a* which is screwed into the internal thread 21*f* of the end member 21. The nipple 26 is sealed with an annular seal 27 and forms the primary or pressure outlet 10 and, together with the end member 21, the valve housing of the non-return valve 25. The nipple 26 has an axial, stepped through-hole which, together with a section of the hole 21*e*, forms the passage 28 of the non-return valve 25. An axially displaceable closure member 30 is arranged in the passage 28. Said closure member consists of fluorine-containing plastic and is pressed by a spring 31 against a shoulder surface of the passage 28, which shoulder surface serves as a valve seat.

Figure 6:
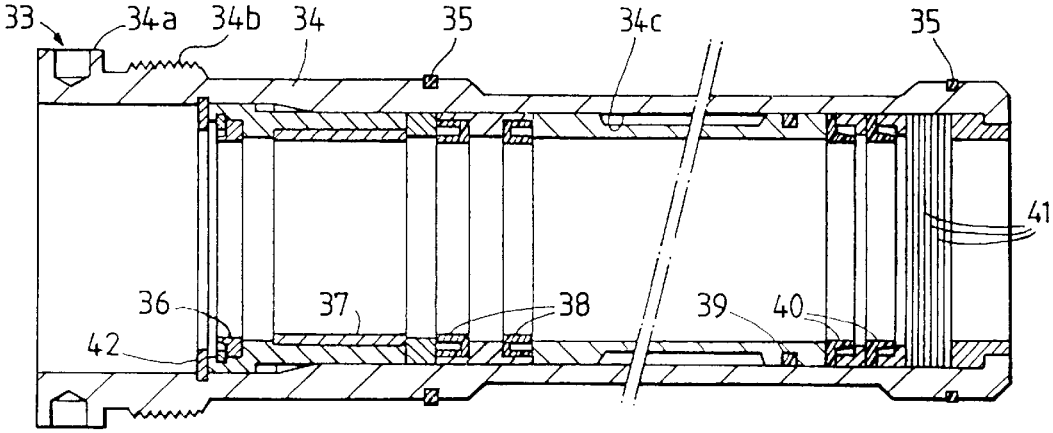
FIG. 6 shows a longitudinal section through the sealing insert which serves for sealing the piston rod, on an even larger scale than FIGS. 3 to 5.

A sealing insert 33 shown separately in FIG. 6 possesses a sleeve-like, dimensionally stable, metallic seal holder 34. This has a collar 34*a* at one end and an external thread 34*b* in its vicinity. The outer surface of the seal holder 34 has at least one annular groove and, for example, two such grooves. The seal holder 34 furthermore has an axial through-hole 34*c*. This possesses a cylindrical middle section which extends over the major part of the length of the seal holder. The hole 34*c* has a generally likewise cylindrical extension at its end facing the drive device 3 and a short constriction at its other end.

The seal holder 34 is inserted into the inner space of the bearer 13 from the left side of FIG. 2—i.e. from that side of the bearer 13 which faces the drive device 3—and its external thread 34*b* is screwed into the internal thread 13*d* of the bearer 13 so that the collar 34*a* is adjacent to that end of the sleeve-like bearer 13 which is located on the left in FIG. 1. The seal holder 34 extends to the right almost through the entire narrower cylindrical section 13*e* of the bearer inner surface 13*b*, almost as far as the shoulder surface 13*f* present in the bearer. The annular grooves present in the outer surface of the seal holder 34 contain annular seals 35 which consist, for example, of a plastic and seal the seal holder from the section 13*e* of the bearer inner surface 13*b*. The axial hole 34*c* contains various parts shown in FIG. 6, including a Seeger ring 42 arranged in the vicinity of the left end of the seal holder 34. Between said ring and the other end of the seal holder are arranged an ice scraper 36, a guide bush 37, annular seals 38, 39, 40, for example having different cross-sectional shapes, some plate springs 41 and also some other annular or sleeve-like parts for holding the guide bush 37 and the seals 38, 39, 40 in the intended positions. The guide bush 37 consists of a metallic jacket, namely bronze, and of a fluorine-containing plastic. The seals 38, 39, 40 consist of plastic. The remaining parts arranged in the seal holder consist of metallic materials. It should also be noted that the parts arranged in the seal holder have been omitted in FIGS. 2 and 3 for the sake of simplicity.

A metallic piston 43, for example a piston 43 consisting of bronze, is displaceably guided in the bush 19. The piston 43 has a generally cylindrical outer surface which is provided with some annular grooves. Annular seals 44, 45 interrupted at a circumferential point are inserted into said grooves. Said seals have different cross-sectional shapes and consist, for example, of a fluorine-containing polymer. The piston 43 has an axial blind hole 43*a* which opens into that end face of the piston facing the end member 21 and which has a conical orifice section there. Furthermore, the piston 43 has holes 43*b* which penetrate it from its end facing away from the end member 21, are inclined with respect to the axis 8 and open into the base section of the blind hole 43*a*. The piston 43 is connected to one end of a multi-part piston rod 47 which projects through the seal insert 33 and out of the bearer 13. The piston rod 47 is displaceably guided by the guide bush 37 of the seal insert 33. The seals 35, 38, 39 and 40 held outside or inside the seal holder 34 by the latter connect the piston rod 47 indirectly and tightly to the bearer inner surface 13*b* and thus seal the outward passage of the piston rod from that region of the bearer inner space which contains the bush 19. The piston rod 47 has, at its end facing away from the piston 43 and projecting out of the bearer 13 and the seal insert 33, an axial blind hole 47*a* with an internal thread, and is detachably connected, namely screwed, there to that movable part 5 of the drive device 3 which is displaceable parallel to the axis 8. However, it should be noted that the piston rod could also be detachably connected to the drive device by other connecting means.

The guide member 51 which is shown in somewhat simplified form and has a guide hole coaxial with the axis 8 and some axial through holes distributed around said guide hole is fixed in the axial blind hole 43*a* of the piston 43. A closure member 52 possesses a shaft, displaceably guided in the guide hole of the guide member 51, and a disc. One end of a spring 53 surrounding the shaft of the closure member 52 engages the guide member 51 and the other end of said spring engages a nut screwed to the shaft and exerts a force, directed away from the end member 21, on the closure member 52. The holes 43*a*, 43*b* of the piston, the guide member 51, the closure member 52 and the spring 53 together form a non-return valve 55 having a passage passing through the piston. The closure member 52 is shown in FIG. 3 in its release position, in which fluid can flow through the non-return valve 55. Starting from the release position shown, the closure member 52 can be pushed by the spring 53 to the left into a closed position in which the disc of the closure member 52 rests on the conical orifice section of the blind hole 43*a*, which section serves as a valve seat.

Those sections of the bearer inner surface 13*b* and of the bush outer surface 19*a* which face one another and are a distance away from one another in parts together bound a free intermediate space 61 which is formed by a region of the bearer inner space. The intermediate space 61 has an intermediate space region 61*a* between the cylindrical sections 19*e* and 19*f* of the bush outer surface 19*a* and that part of the cylindrical section 13*g* of the bearer inner surface 13*b* which is opposite these sections 19*e*, 19*f*. Said region 61*a* is annular in cross-section, encloses the bush 19 without interruption along the entire circumference of said bush and is also referred to as a first, annular inner space region of the bearer. The grooves 19*i* of the bush 19, together with those parts of the cylindrical section 13*g* of the bearer inner surface 13*b* which are opposite said grooves, bound channel-like intermediate space regions 61*b* which are parallel to the axis 8 and uniformly distributed around said axis and around the bush. The passage of the inlet 9 opens into the deepest point of the annular intermediate space region 61*a*. This is connected, through the filter 23 and the annular groove 19*s* and the holes 19*b* of the bush 19, to a bearer inner space region which is located in FIGS. 2 and 3 to the left of the piston 43 and at least to a large extent between the bush inner surface 19*b* and the piston rod 47. Said bearer inner space region is referred to below as intake chamber 62. Since the diameter of the piston rod is smaller than the diameter of the piston, the magnitude of the volume of the intake chamber 62 changes on displacement of the piston. When the piston is in its end position furthest away from the end member 21, the volume of the intake chamber is substantially smaller than when the piston is in its end position closest to the end member 21. The intake chamber 62 is in turn connected through the piston, via the non-return valve 55 present in and/or on the piston, to a pump chamber 63 which, in cross-section, is surrounded by the bush inner surface 19*b* and bounded by the facing surfaces of the end member 21 and of the piston 43. It should be noted that the axial dimension and the volume of the pump chamber 63 changes on displacement of the piston and in particular becomes at least approximately zero when the piston is pushed to its end position closest to the end member 21. The pump chamber 63 is connected via the non-return valve 25 to the nipple 26 forming the primary or pressure outlet 10. The channel-like intermediate space regions 61*b* open, at their ends closer to the end member 21, into a free, second annular inner space region 64 of the bearer inner space, which inner space region is present between the cylindrical section 13*g* of the bearer inner surface 13*b* and the surface of the end member which is opposite said bearer inner surface and a distance away. The inner space region 64 is connected to the passage of the secondary or return outlet 11. The inlet 9 is thus connected on the one hand to the pump chamber 63 via the intake chamber 62 and the non-return valve 55 present in the piston 43 and, on the other hand, to the secondary or return outlet 11 by the intermediate space 61 adjacent to sections of the bush outer surface 19*a*. Close to the opposite ends of the bush 19, the passages of the inlet 9 and of the secondary or return outlet 11 are connected to the intermediate space 61 at points of the bush 19 and of the intermediate space 61 which are parallel to the axis 8 and a distance apart. This distance is preferably at least 50% and, for example, at least 70% of the length of the bush 19.

FIG. 1 also shows a reservoir 71. This consists, for example, of a double-walled tank having an inner space which is tightly sealed all round from the environment. The reservoir 71 contains a cryogenic fluid 72 having a liquid phase and a gaseous or vapour-like phase present above the liquid level. The reservoir 71 is preferably arranged above the pump 2 and is connected to the inlet 9 of the pump 2 by a feed line 73 opening into its inner space close to its deepest point and by valve 74 present in said feed line. The feed line 73 has a section which runs approximately vertically downward from the reservoir 71 and, at the lower end of said section, an arc which forms a siphon trap. The pipe then runs from this with a slight upward inclination to the inlet 9, the valve 74 being arranged, for example, between the siphon trap and the inlet 9. The primary or pressure outlet 10 of the pump 2 is connected to a filling apparatus 76, for example by a line 75. The secondary or return outlet 11 is connected to the reservoir 71 by a return line 77 having a valve 78. The return line 77 has a section which slopes slightly upward away from the outlet 11 and contains the valve 78, a siphon trap formed by an arc and a section rising approximately vertically away from this. This latter section opens, above the opening of the feed line 73, into the inner space of the reservoir 71, at least the orifice section of the return line being exactly vertical and having an orifice which is open at the top.

The maximum external diameter of that longitudinal section of the bearer 13 containing the bush 19, and preferably of the entire bearer, is at most 3 times, preferably at most 2.5 times and, for example, approximately twice, the external diameter of the piston 43. The external diameter of each section of the bearer 13 which surrounds the bush 19 in cross-section is furthermore at most 50% greater than the external diameter of the bush section present in the relevant section of the bearer. The dimension of the intermediate space 61 which is measured radially with respect to the axis 8 is preferably, at least essentially in the entire intermediate space, at most 20% and, for example, at most or about 10% of the diameter of the bush 19 at the relevant point of the bush and of the intermediate space. The passage of the inlet 9 and the passage of the secondary or return outlet 11 preferably have passage cross-sectional areas which are approximately equal to those of the lines 73, 77. Channel-like intermediate space regions 61*b* together have a passage cross-sectional area which is at most 3 times, preferably at most twice and, for example, 50% to 150% of the passage cross-sectional areas of the inlet 9 and of the secondary or return outlet 11. The annular intermediate space regions 61*a*, the intake chamber 62 and the annular bearer inner space region 64 likewise have relatively small passage cross-sectional areas and volumes.

The operation of the pump 2 will now be explained. The pressure of the fluid present in the reservoir 71 is preferably greater than the ambient air pressure and is preferably at most 1.5 MPa and, for example, about 0.3 MPa to 1 MPa. During normal operation of the pump 2, the reservoir 71 should preferably contain an amount of the liquid phase of the fluid 72 such that the liquid level is above the orifice of the return pipe 77. The reservoir 71, together with those sections of the lines 73, 77 connected to its inner space, then forms a so-called thermosiphon tank. Owing to the gravitational force acting on the fluid present in the reservoir, the pressure of said fluid at the orifice of the feed line 73 is greater than that at the orifice of the return line 77.

During operation of the pump 2, the drive device 3 displaces the piston 43 back and forth along the axis 8 in the bush 19 guiding the piston 43, so that the piston performs a suction stroke and a compression stroke alternately. During the suction stroke, the piston 43 is displaced in the direction denoted by an arrow in FIGS. 2 and 3, away from the end member 21 and toward the drive device 3. The two valves 74 and 78 are opened before the pump 2 is put into operation, so that liquid fluid 72 can flow, at least partly and preferably as completely as possible, from the reservoir 71 through the inlet 9 into the intermediate space 61 of the pump. During the suction stroke of the piston 43, the disc of the closure member 52 is raised from the valve seat of the non-return valve 55, as shown in FIGS. 2 and 3. Furthermore, the volume of the intake chamber 62 is reduced while the volume of the pump chamber 63 is increased. The piston then transports fluid from the intake chamber 62 through the holes 43*a*, 43*b* of the piston 43, which together form the passage of the non-return valve 55, into the pump chamber 63. If necessary, further fluid may also flow from the reservoir 71 into the intake chamber 62. The non-return valve 25 is closed during the suction stroke.

If the piston is displaced toward the end member 21 during the subsequent compression stroke, the non-return valve 55 closes while the non-return valve 25 is opened. During the compression stroke, the piston forces fluid out of the pump chamber 63 through the passage of the non-return valve 25 to the primary or pressure outlet 10, the pressure of the fluid being increased, for example, 10 times to 100 times or possibly even more. This fluid, which is at least partly liquid and, for example, liquid for the most part or completely, then flows through the line 75 to the filling apparatus 76 and is, for example, first vaporized by said apparatus and then filled in the gaseous state at least approximately at the pressure generated by the pump 2 into pressure-resistant containers, or possibly filled in the liquid state without prior vaporization into pressure-resistant containers. During the compression stroke, the volume of the intake chamber 62 becomes greater, so that the piston sucks fluid from the reservoir 71 through the inlet 9, the annular intermediate space region 61*a*, the filter 23, the annular groove 19*s* and the holes 19*p* into the intake chamber 62.

During the operation of the pump 2, a part of the fluid entering the annular intermediate region 61 through the inlet 9 flows through the channel-like intermediate space regions 61*b* into the inner space region 64 and from this through the secondary or return outlet 11 and through the return pipe 77 back into the reservoir 71. This flow is maintained by the pressure difference present in the inner space of the reservoir between the orifices of the two lines 73, 77, by the thermally generated convection and by the suction effect produced by the piston during its suction strokes, so that, during the operation of the pump, fluid flows continuously and possibly in a more or less highly pulsating manner or at least intermittently in the manner described through the intermediate space regions 61*a*, 61*b* and the return line 73. The conical transition surface which forms the end surfaces of the ribs 19*h* and is present at the ends of the section 19*g* of the bush outer surface 19*a* counteracts the formation of turbulence in the fluid when the latter flows into the channel-like intermediate space regions 61*b* and out of these again.

That longitudinal section of the bearer which contains the bush 19 has only a relatively small circumference and only a relatively small outer surface compared with the diameter of the piston 43. The evacuated cavity 17 furthermore thermally insulates from the environment that longitudinal region of the sleeve-like bearer 13 which contains the greatest part of the bush and a part of the piston rod 47. Thus, only a relatively small quantity of heat passes from the air surrounding the pump housing 7 through the bearer 13 and the end member 21 into those regions of the bearer inner space which contain the cryogenic fluid and to the bush 19. Furthermore, a small quantity of heat from the environment and from the drive device 3 is passed through the piston rod 47 to the piston 43. In addition, a part of the mechanical work performed by the piston during pumping may be converted into heat.

The fluid flowing along the bush outer surface 19*a* through the intermediate space and the inner space region 64 thermally insulates the bush 19 from the bearer 13 and the end member and absorbs heat passed through the bearer 13 and the end member 21 from the environment. Furthermore, the fluid flowing through the intermediate space 61 and the inner space region 64 may also absorb heat from the bush 19 and heat passed through its jacket from the inner space of the bush and from the piston 43. The fluid flowing along the bush outer surface 19*a* through the intermediate space regions 61*a*, 61*b* and through the inner space region 64 is thus heated up. Owing to the heating up of fluid, the originally liquid phase of this fluid present in the intermediate space 61 may be partially or temporarily—for example in the initial phase—even completely vaporized, the fluid absorbing heat of vaporization and cooling the surfaces coming into contact with the fluid. The heat absorbed by the fluid in the form of a temperature increase and/or in the form of heat of vaporization is transported away from the pump 2 by the fluid flowing out through the secondary or return outlet 11, and then reaches the reservoir 71.

The fluid flowing from the inlet 9 through the intermediate space 61 and through the inner space region 64 thus permits effective thermal insulation and cooling of the bush 19 without that part of the bearer 13 which contains the bush 19, and the end member 21, having to be arranged in a beaker containing liquid, cryogenic fluid. The formation and the arrangement of the bush 19 in the bearer 13 ensure that there is a defined, pronounced continuous and/or pulsating fluid flow constantly in all free regions of the bearer inner space which contain cryogenic fluid. Accordingly, neither greatly heated liquid nor any bubbles of gaseous fluid remain in any region of the bearer inner space for a relatively long time during operation of the pump. Furthermore, fluid arriving from the inlet 9 during operation of the pump is sucked by the shortest route into the intake chamber 62. The fluid entering the intake chamber is therefore relatively cold and at least almost completely liquid. In addition, the fluid present in the intake chamber 62 at the end of a compression stroke is for the most part transported through the piston into the pump chamber 63. In particular, virtually no gas bubbles or warm, liquid fluid can therefore remain in the bush and in the piston for a relatively long time. For these reasons, the pump can deliver fluid continuously for a long time with high, approximately constant efficiency and can increase the pressure of said fluid.

When the pump 2 is started, the fluid flowing along the bush outer surface through the intermediate space 61 and the intermediate space region 64 cools the bush 19, that region of the end member 21 which is adjacent to the bearer inner space, the piston 43 and other parts which come into contact with the pumped fluid during operation of the pump rapidly to a temperature at which the liquid phase or the fluid pumped to the primary or pressure outlet 10 remains liquid. Only relatively little liquid fluid must be vaporized in order to cool the parts coming into contact with the liquid to be pumped from normal room temperature to a temperature permitting the pumping of liquefied gas.

The filter 23 has, for example, a mesh size of 0.2 mm to 0.3 mm, so that it retains large, solid particles—such as metal chips and the like. As already described in the introduction, the fluid stored in the reservoir may contain fine, particulate impurities, for example particles of carbon compounds. Such fine impurity particles have, for example, sizes of a few micrometres. If particles of this type are dispersed in the liquid phase of the fluid present in the reservoir, such particles may enter the pump and also pass through the filter 23, together with the fluid. Since the fluid entering the pump flows continuously or at least intermittently through all fluid-containing inner space regions of the pump, virtually all fine impurity particles transported into the pump by the fluid are transported out of the pump again by the fluid and are not deposited in the pump.

If the pump 2 is switched off at the end of a pumping cycle and if the reservoir 71 is empty, the two valves 74, 78 can be closed. The arrangement and formation of the reservoir 71 and of the pipes 73, 77 then prevent the lines 73, 77 from freezing owing to, for example, humid air which enters them.

The various parts of the pump are relatively simple to produce and can be assembled in particular in a short time and with little labour. For example, the end member 21 need only be screwed with its external thread 21*d* into the internal thread 13*i* of the sleeve-like bearer 13 and then also firmly holds the bush 19 inserted into the bearer inner space beforehand. The nipple 26 likewise need only be screwed into the end member 21. Furthermore, the seal insert 33 with all seals which belong to it and other parts can be inserted as a whole into the bearer 13 and screwed in. Moreover, the piston rod 47 can be rapidly screwed together with the movable part 5 of the drive device 3, and the bearer 13 can be rapidly screwed together with the connecting section 4*c* of the support 4.

During maintenance of the pump 2, it may be necessary to make certain regions of the bearer inner space accessible in order, for example, to clean the filter 23 and/or any other surfaces and parts present inside the bearer or to replace a worn or otherwise damaged part—such as, for example, one of the seals 44, 45 fixed to the piston or one of the seals 38, 40 which come into contact with the piston rod. For such maintenance work, the pump 2 can be dismantled to the necessary extent and then reassembled. If, for example, the bush 19 is to be made accessible and removed, it is merely necessary for this purpose to unscrew the end member 21 from the sleeve-like bearer 13. The bush is then displaceable and can be pushed out and/or pulled out from the bearer inner space by moving the piston at that end of the bearer inner space which was previously closed by the end member 21. If necessary, it is also possible to unscrew the bearer 13 from the support 4 and/or the piston rod 47 from the part 5 and to remove the piston from the bearer. If a user of the pump wishes, for example, to replace the seals 38, 40 used for sealing the piston rod 47, he can unscrew the sleeve-like bearer 13 from the support 4, unscrew the seal insert 33 from the bearer, screw a reserve seal insert into the bearer and then have the removed seal insert inspected, for example by the supplier of the pump. Maintenance of the pump thus requires only a small amount of work and time and in particular only short stoppages of the operation of the pump. A particular advantage is that the end member 21 and that end section of the bearer 13 which is connected to said end member are directly adjacent to the space surrounding the pump and are thus accessible from the environment of the pump without having first to remove a container enclosing the bearer and containing liquefied gas during operation.

The pump can be modified in various respects.

For example, the channel-like intermediate space regions 61*b* parallel to the axis of the bush can be replaced by channel-like intermediate space regions which run along helical lines completely or partly around the bush. It is even possible for only a single, channel-like intermediate space region running along a helical line to be provided. Furthermore, it would be possible for that section of the bush outer surface which is adjacent to the bearer inner surface to be formed by a smooth cylindrical surface and in this case to provide the bearer inner surface with ribs and/or grooves, so that the bearer inner surface and the bush outer surface have sections which are adjacent to one another and sections which are separated from one another by an intermediate space. Furthermore, the holes 19*p* of the bush can be replaced by at least one incision cut into the jacket of the bush from the end surface 19*c*, and preferably by a plurality of such incisions. The inlet may open into an annular, first bearer inner space region which surrounds the axis 8 and partly surrounds the bush 19 and partly projects beyond that end of the bush 19 located on the left in FIGS. 2 and 3, or which is even located completely to the left of that end of the bush 19 facing away from the pump chamber 63 and which surrounds the piston rod 47 between the bush 19 and the seal insert 33.

It would also be possible to provide that section of the bearer which contains the bush also with a heat-insulating sleeve which consists of, for example, plastic and which then forms a part of the bearer inner surface and radially supports and centres the bush at certain points.

Furthermore, in addition to the non-return valve 55 present in the piston or instead of said valve, it would be possible to provide fluid induction means which have a non-return valve and connect the inlet of the pump through the end member 21 to the pump chamber. This non-return valve could then be formed similarly to the corresponding non-return valve of the pump disclosed in U.S. Pat. No. 4,915,602 cited in the introduction.

In addition, the metallic bearer 13 and/or the metallic jacket 16 and/or the metallic end member 21 could also be provided with a heat insulation comprising a nonmetallic, heat-insulating material.

Moreover, the return pipe 77 may open above the liquid level into the inner space of the reservoir 71.

The filling apparatus 76 can be replaced, for example, by a tank for receiving the fluid pumped by the pump and compressed or by any apparatus for the operation of which a cryogenic fluid under high pressure is required.

What is claimed is:

1. A pump for pumping a fluid comprising a liquefied gas, comprising a bearer; a bush arranged at least partly therein; a piston displaceable along an axis in the bush; an inlet; a primary outlet and a secondary outlet; the bearer having a bearer inner surface and the bush having a bush outer surface which is supported in parts by the bearer inner surface and is separate in parts from the bearer inner surface by an intermediate space, the piston bounding a pump chamber, the inlet and the secondary outlet being connected to the intermediate space and the inlet being connected via a first non-return valve to the pump chamber and the pump chamber being connected via a second non-return valve to the primary outlet, wherein the secondary outlet is connected to the intermediate space at a point which is a distance away, along the axis, from a point at which the intermediate space is connected to the inlet; wherein the bearer has, at an end thereof located closer to the primary outlet, an orifice which is closed by an end member, wherein the bearer and the end member have respective threads screwed together for connecting the bearer and the end member together, wherein the end member projects into the bearer, engages the bush inside the bearer, presses the bush against a shoulder surface of the bearer and closes the pump chamber at a side of the pump chamber remote from the end face of the piston, and wherein the bush can be removed from the bearer through the orifice of the bearer when the end member is removed from the bearer.

2. A pump for pumping a fluid comprising a liquefied gas, comprising a bearer, a bush arranged at least partly therein, a piston displaceable along an axis in the bush, an inlet, a primary outlet and a secondary outlet, the bearer having a bearer inner surface and the bush having a bush outer surface which is supported in parts by the bearer inner surface and is separated in parts from the bearer inner surface by an intermediate space, the piston bounding a pump chamber, the inlet and the secondary outlet being connected to the intermediate space and the inlet being connected via a first non-return valve to the pump chamber and the pump chamber being connected via a second non-return valve to the primary outlet, wherein the secondary outlet is connected to the intermediate space at a point which is a distance away, along the axis, from a point at which the intermediate space is connected to the inlet, wherein a dimension of the intermediate space measured radially with respect to the axis is essentially, at each point of said intermediate space, at most 20% of the diameter of the bush at a relevant point, and wherein longitudinal section of the bearer which contains the bush has a maximum external diameter which is at most 3 times of an external diameter of the piston.

3. A pump as claimed in claim 2, wherein the dimension of the intermediate space measured radially with respect to the axis is essentially, at each point of said intermediate space, at most 15% of the diameter of the bush at the relevant point.

4. A pump as claimed in claim 2, wherein the bush is located completely and over an entire length thereof in an inner space surrounded in cross-section by the bearer.

5. A pump as claimed in claim 2, wherein an intake chamber which is present at least partly inside the bush, is separated from the pump chamber by the piston and is connected to the pump chamber through the piston via the first non-return valve, wherein the inlet and the intake chamber are connected to an inner space region of the bearer, and wherein the inner space region of the bearer is connected, by a least one region of the intermediate space which extends along the axis, to an inner space region connected to the secondary outlet.

6. A pump as claimed in claim 3, wherein the secondary outlet is connected to the inner space region at a point which is located above a point at which the inlet opens into the inner space region of the bearer.

7. A pump as claimed in claim 5, wherein the inner space region of the bearer is formed by an annular region of the intermediate space which surrounds the bush in cross-section, wherein the inner space region connected to the secondary outlet is annular and surrounds in cross-section and end of the bush which contains at least one of the pump chamber and an end member which closes the bush at this end, and wherein the intake chamber has a volume whose magnitude is changed by displacements of the piston.

8. A pump as claimed in claim 7, wherein the bush has a jacket which surrounds the axis and possesses at least one hole connecting the inner space region of the bearer to the intake chamber.

9. A pump as claimed in claim 2, wherein the intermediate space has a plurality of channel-like intermediate space regions distributed around the bush.

10. A pump as claimed in claim 7, wherein that dimension of the channel-like intermediate space regions which is measured along the axis is at least 30% of a total length of the bush.

11. A pump as claimed in claim 2, wherein the point at which the secondary outlet is connected to the intermediate space is separated from the point at which the intermediate space is connected to the inlet by a distance, measured along the axis, of at least 50% of a total length of the bush.

12. A pump as claimed in claim 2, wherein a jacket which surrounds the bearer in cross-section is fixed in the bearer, the jacket, together with the bearer, bounding a cavity which is tightly sealed from environment and is at least one of evacuated and connected to a connection permitting evacuation thereof and which extends at least over a major part of a length of the bush.

13. A pump as claimed in claim 2, further comprising a drive device having a support, wherein the bearer is formed by a one-piece sleeve extending from the support up to at least the pump chamber, wherein the support and the bearer are detachably connected to one another, wherein the piston is connected to a movable part of the drive device by a piston rod passing through the inner space of the bearer, wherein the pump further comprises a seal insert which seals the piston rod from the bearer, has a plurality of annular seals coming into contact with the piston rod and is located at least partly in the bearer, wherein the bearer and the seal insert are detachably connected to one another, and wherein the seal insert can be removed from the bearer at an end of the bearer which is connected to the support.

14. A pump as claimed in claim 13, wherein the support and the bearer have cooperating threads for connecting the bearer and the support together, and wherein the bearer and the seal insert have cooperating threads for connecting the bearer and the seal insert together.

15. An apparatus comprising:

a pump for pumping a fluid comprising a liquefied gas, comprising a bearer, a bush arranged at least partly therein, a piston displaceable along an axis in said bush, an inlet, a primary outlet and a secondary outlet, the bearer having a bearer inner surface and the bush having a bush outer surface which is supported in parts by the bearer inner surface and is separated in parts from the bearer inner surface by an intermediate space, the piston bounding a pump chamber, the inlet and the secondary outlet being connected to the intermediate space and the inlet being connected via a first non-return valve to the pump chamber and the pump chamber being connected via a second non-return valve to the primary outlet, wherein the secondary outlet is connected to the intermediate space at a point which is a distance away, along the axis, from a point at which the intermediate space is connected to the inlet, and wherein a dimension of the intermediate space measured radially with respect to the axis is essentially, at each point of said intermediate space, at most 20% of a diameter of the bush at the relevant point, and wherein a longitudinal section of the bearer which contains the bush has a maximum external diameter which is at most 3 times of an external diameter of the piston; and a reservoir having an interior for storing the fluid comprising liquefied gas, wherein the reservoir is connected to the inlet of the pump by a feed line, wherein the second outlet of the pump is connected to the reservoir by a return line, and wherein the return line opens into an interior of the reservoir at an entrance which is above a point at which the feed line is connected to the interior of the reservoir.

16. An apparatus as claimed in claim 15, wherein the feed line includes a valve, wherein the return line includes a valve, and wherein the inlet, the secondary outlet and the intermediate space are configured in such a manner that fluid flows from the reservoir through the feed line to the inlet, through the intermediate space to the secondary outlet and through the return line back into the reservoir under the influence of a pressure difference between the entrance of the return line in the reservoir and the point at which the feed line is connected to the interior of the reservoir and under the influence of thermally generated convection when the reservoir contains fluid in a liquid state having a liquid level above the entrance of the return line and when the valves in the feed and return lines are open.

17. An apparatus as claimed in claim 16, wherein the inlet, the secondary outlet and the intermediate space are configured so that the fluid present in the intermediate space and flowing therethrough is at least partly in the liquid state during normal operation of the pump.

18. An apparatus as claimed in claim 15, wherein the feed line and the return line each contain a valve and a siphon trap.

19. An apparatus as claimed in claim 15, wherein an orifice of the return line is located below a liquid level of the fluid in the reservoir.

20. A pump for pumping a fluid comprising a liquefied gas, comprising a bearer; a separate bush arranged at least partly therein; an end member closing the bush at an end thereof, a piston displaceable along an axis in the bush; an inlet; a primary outlet and a secondary outlet; the bearer having a bearer inner surface and the bush having a bush outer surface which is supported in parts by the bearer inner surface and is separated in parts from the bearer inner surface by an intermediate space, the bearer containing an inner space having a first inner space region and a second inner space region, wherein the first inner space region is formed at least partly by an annular region of the intermediate space which surrounds the bush in cross-section, wherein the second inner space region is annular and surrounds in cross-section a portion at the end of the bush which is closed by at least a portion of the end member, wherein an intake chamber is present partly inside the bush, wherein a pump chamber is bounded by the bush, the end member and the piston and is separated from the intake chamber by the piston, wherein the inlet is connected to the annular region of the intermediate space, wherein the annular region of the intermediate space is connected to the intake chamber, wherein the intake chamber is connected through the piston via a first non-return valve to the pump chamber, wherein the pump chamber is connected via a second non-return valve to the primary outlet, wherein the second inner space region is connected to the secondary outlet at a point which is a distance away, along the axis from a point at which the inlet is connected to the intermediate space, and wherein the inlet and the secondary outlet are connected to one another via the intermediate space by permanently free passages.

21. A pump as claimed in claim 20, wherein the bush is located completely and over an entire length thereof in an inner space surrounded in cross-section by the bearer.

22. A pump as claimed in claim 20, wherein the bush has a jacket which surrounds the axis and possesses at least one hole connecting the first inner space region to the intake chamber.

23. A pump as claimed in claim 20, wherein said intermediate space is configured in such a manner that fluid being at least partly in the liquid state flows from the inlet into the intermediate space during the operation of the pump.

24. A pump as claimed in claim 20, wherein said intermediate space has a plurality of channel-like intermediate space regions distributed around the bush.

25. A pump as claimed in claim 24, wherein said plurality of channel-like intermediate space regions include at least three of the channel-like space regions.

26. A pump as claimed in claim 20, wherein the inlet opens into a deepest point of the annular region of the intermediate space, and wherein the annular second inner space region is connected to the secondary outlet at a point located above the point of the annular region of the intermediate space.

* * * * *